US005611609A

United States Patent [19]

Katz et al.

[11] Patent Number: 5,611,609

[45] Date of Patent: Mar. 18, 1997

[54] APPLIANCE HOUSING ASSEMBLY

[75] Inventors: Jonathan M. Katz; Scott A. Calvert; Nasser Hosseinpour; William E. Nuttall, all of Louisville, Ky.

[73] Assignee: General Electric Company, Louisville, Ky.

[21] Appl. No.: 416,058

[22] Filed: Apr. 4, 1995

[51] Int. Cl.[6] ..... A47B 47/00

[52] U.S. Cl. ..... 312/263; 312/265.5; 312/279

[58] Field of Search ..... 312/293.3, 293.2, 312/293.1, 140.4, 279, 248, 263, 265.5, 265.6, 257.1, 223.1, 228; 220/4.02

[56] References Cited

U.S. PATENT DOCUMENTS

| | | | |
|---|---|---|---|
| 3,253,874 | 5/1966 | Czech | 312/257 |
| 3,338,232 | 8/1967 | Heldenbrand | 312/279 X |
| 3,347,609 | 10/1967 | Mann | 312/263 |
| 4,003,613 | 1/1977 | Oakley | 312/293 |
| 4,288,133 | 9/1981 | Deatherage | 312/279 |
| 4,507,942 | 4/1985 | Hirose et al. | 312/223.1 X |
| 4,765,698 | 8/1988 | Dooley | 312/248 |
| 4,798,424 | 1/1989 | Coates et al. | 312/257 R |
| 4,840,285 | 6/1989 | Carr | 220/4.02 |
| 5,350,140 | 9/1994 | Ripley et al. | 312/257.1 X |
| 5,358,323 | 10/1994 | Ripley | 312/263 X |
| 5,375,921 | 12/1994 | Tupa et al. | 312/279 X |

FOREIGN PATENT DOCUMENTS

| | | | |
|---|---|---|---|
| 22948 | 3/1978 | Japan | 312/265.6 |

*Primary Examiner*—Peter M. Cuomo
*Assistant Examiner*—Janet M. Wilkens
*Attorney, Agent, or Firm*—H. Neil Houser

[57] ABSTRACT

A housing assembly for an appliance, such as a front loading clothes dryer, includes side panels joined by a front panel. A cover includes a front member and a rear member. The rear member is mounted on the side panels while the rear portion of the front member is positioned between the top of the side panels and upwardly offset front portions of the rear member. Tabs and slots align the front cover member with the top of the housing front and side panels and fasteners connect the front member to the front panel. A control housing includes an assembly of an elongated rear wall connected to a pair of spaced apart end caps. The end caps are mounted on the rear cover member and the rear wall extends across the rear of the cover. A control panel assembly is mounted on the rear portion of the front cover member and is attached to the rear wall/end cap assembly.

8 Claims, 3 Drawing Sheets

APPLIANCE HOUSING ASSEMBLY

BACKGROUND OF THE INVENTION

This invention relates to appliances and, more particularly, to housing assemblies for front loading appliances like clothes dryers and clothes washers. In such machines the housing includes a front panel and side panels. A cover assembly closes the top of the machine housing and includes a smaller control housing, often called a backsplash, to receive various controls.

It is an object of this invention to provide an improved cover assembly for such appliances.

It is another object to provide such an improved cover assembly that is easily assembled and attached to the housing.

SUMMARY OF THE INVENTION

An appliance housing assembly includes spaced apart side panels or walls joined by a front panel or wall. A cover includes a front member and a rear member. The rear cover member is mounted on the housing side walls while the rear portion of the front cover member is received between the tops of the side walls and upwardly offset front portions of the rear cover member. The front cover member is positioned in register with the top of the side and front walls and is fastened to at least one of the walls. A control housing, or backsplash, includes an assembly of an elongated rear wall joined to a pair of spaced apart end caps. Each of the end caps is mounted on the rear cover member and extends rearward of the front cover member, with the rear wall extending across the rear of the cover. The control housing also includes a control panel assembly mounted on the rear portion of the front cover member and attached to the rear wall/end cap assembly.

DETAILED DESCRIPTION OF PREFERRED EMBODIMENT

Figure 1:
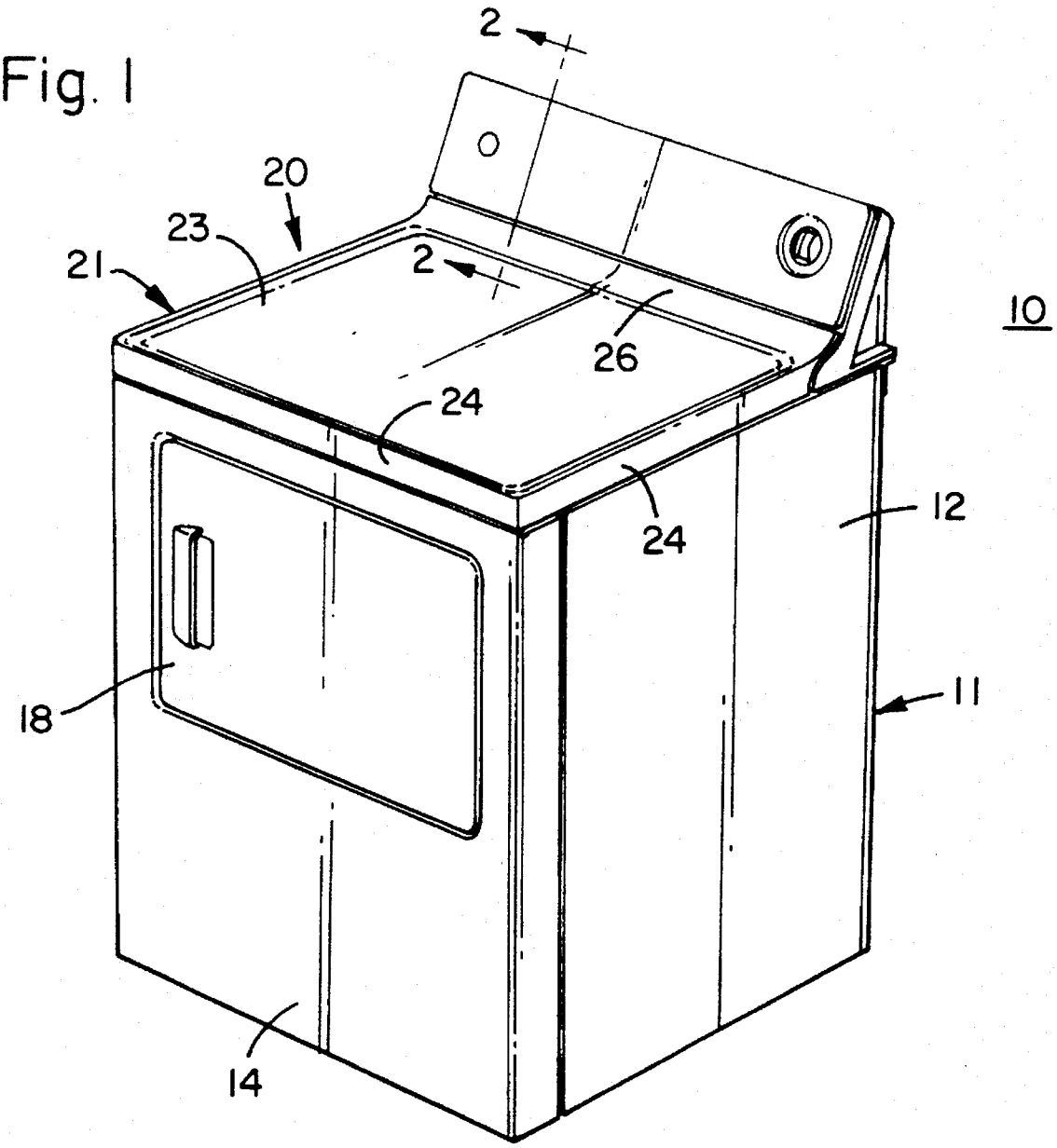
FIG. 1 is a front perspective view of a front loading clothes dryer incorporating one embodiment of the present invention.
Figure 3:
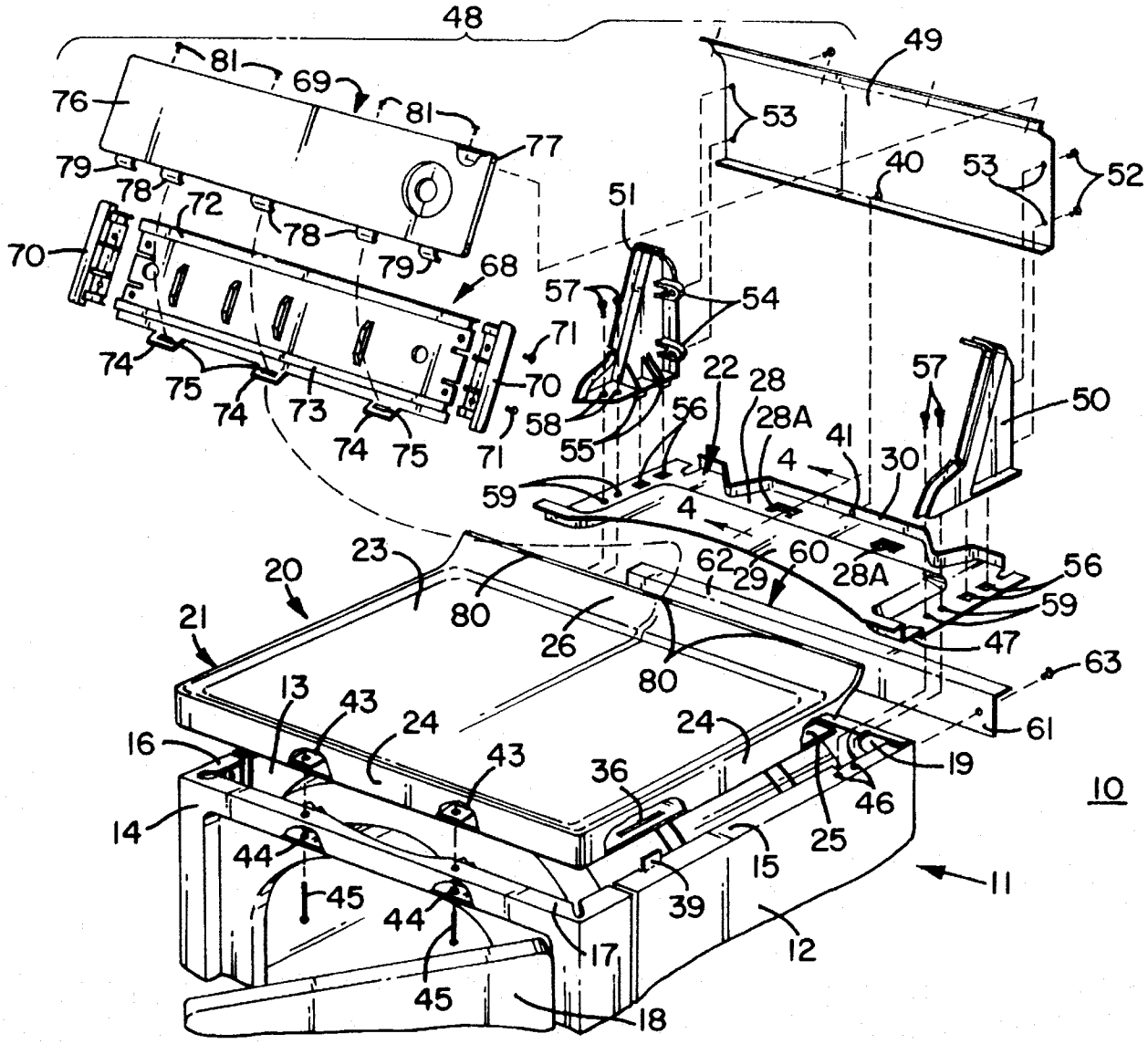
FIG. 3 is an exploded view illustrating certain aspects of the cover assembly of the appliance of FIG. 1.

Referring to FIGS. 1 and 3, there is illustrated an appliance, in particular a clothes dryer 10, including a cabinet or housing 11. The cabinet 11 includes side walls or panels 12,13 joined by a front wall or panel 14. The panels 12–14 have top ledges 15–17 respectively. A door 18 provides access for loading and unloading fabrics to be dried. A rear wall or panel 19 joins the rear edges of the side panels 12,13. The dryer 10 is of the front service type, that is the front panel 14 is removed to gain access to internal operating components. Thus front panel 14 is separate from side panels 12,13. In rear access machines the front and side panels often are formed from a single sheet of material and collectively are referred to as the wrapper. Often the side and front panels of front service machines also are collectively referred to as the wrapper, even though they are not formed from a unitary member.

The cabinet 11 includes a cover 20 which closes the top of the dryer. The cover 20 includes a front cover member 21 and a rear cover member 22. The front member 21 has an upper panel 23 with a down turned rim 24 extending around its front and side edges. The rim 24 terminates in a lower ledge 25 that underlies the panel 23. The rear portion 26 of front member 21 is upturned or upswept. The rear cover member 22 is in the form of a panel 28 with an upwardly offset front portion 29 and an upward projecting rail 30 along its rear edge.

Figures 2, 4:
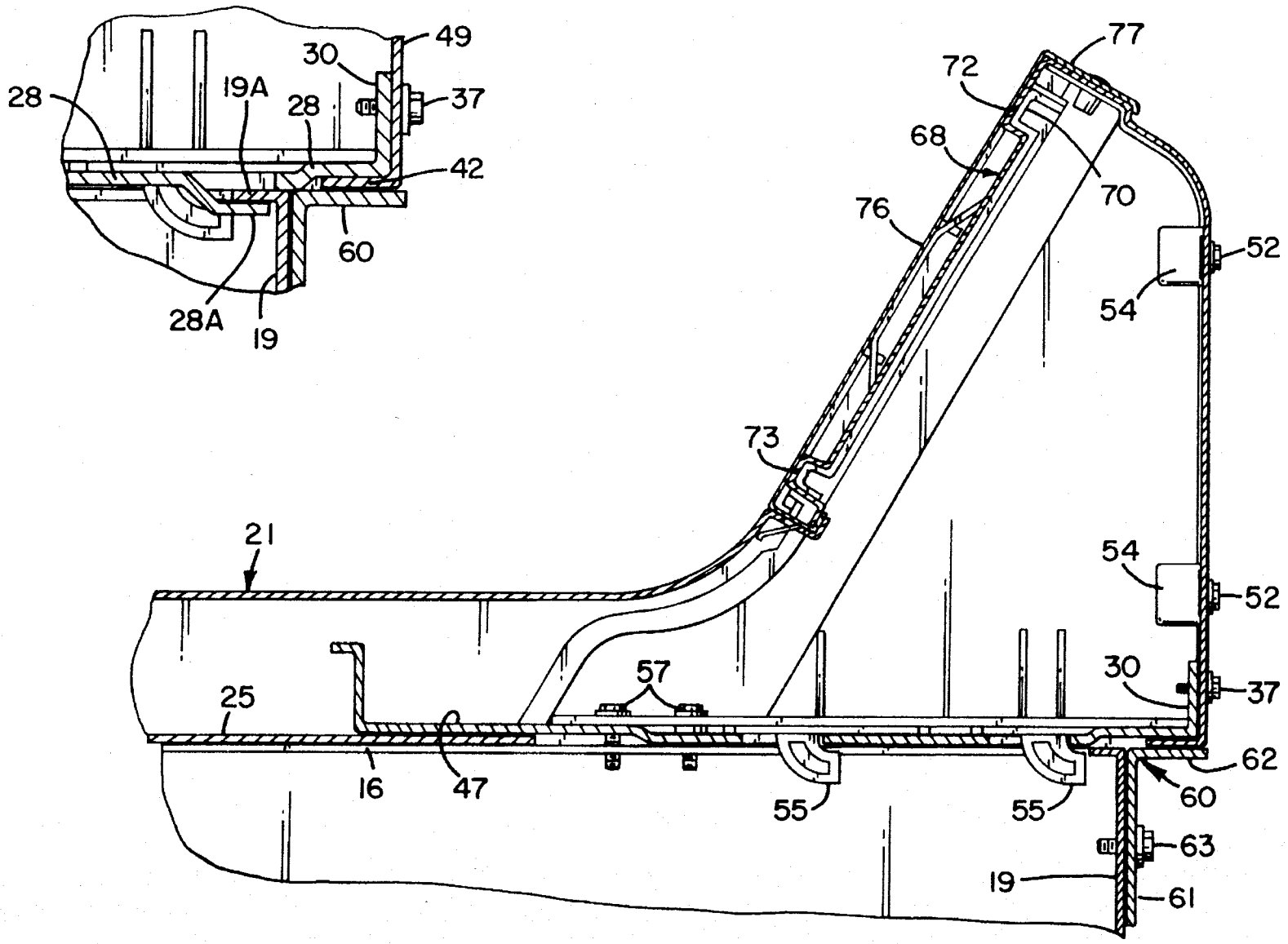
FIG. 2 is a fragmentary cross section view, as seen along line 2—2 in FIG. 1, illustrating certain aspects of the cover assembly.
FIG. 4 is a fragmentary side elevation view generally as seen along line 4—4 in FIG. 3 and illustrating certain additional aspects of the cover assembly.

Referring particularly to FIGS. 2–3, a control housing 48 includes two assemblies. The first assembly includes an elongated control housing rear wall 49 and spaced apart end caps 50,51. The opposite lateral ends of the wall 49 are connected to the end caps 50,51 by threaded fasteners such as screws 52 which pass through openings 53 in the rear wall 49 and are received in tabs 54 in the end cap. The lower center portion of rear wall 49 is secured to rear cover member 22 by a screw 37 which passes through an opening 40 in rear wall 49 and is threaded into an opening 41 in the rear rail 30 of cover member 22 (see FIGS. 3 and 4).

The rear wall/end cap assembly is mounted on the rear cover member 22 by hook and slot arrangements. In the exemplification embodiment the end caps include hooks 55 which are received in slots 56 in the rear cover member 22. Once the hooks are inserted through the slots, the rear wall/end cap assembly is moved rearward so that the hooks overlap the adjacent portions of the rear cover member panel 28. The end caps 50,51 are attached to the rear cover member 22, and the end caps and rear cover member are mounted on the top ledges 15,16 of side walls 12,13, by threaded fasteners, such as screws 57, which pass through openings 58 in the end caps and openings 59 in the rear cover member 22 and are threaded in openings 46 in the ledges 15,16. In addition, plate portion 28 of rear cover member 22 is formed with a pair of downward offset tabs 28A which fit under the top ledge or flange 19A of rear panel 19.

The front portions 47 of the side edges of the rear cover member 22, forward of the openings 59, are slightly offset upward to be positioned or spaced above the top ledges 15,16. The front and rear cover members 21,22 are assembled with the lower ledge 25 of the front member 21 positioned between the offset front portions 47 of the rear cover member 22 and the top ledges 15,16 of side walls 12,13.

The lower ledge 25 on each side of front cover member 21 is formed with a narrow, elongated slot 36 extending front to back of the cover. The corresponding portions of the top ledges 15,16 are formed with flat pins or tabs 39. The front portion of ledge 25 is provided with a pair of spaced apart, clip-on nuts 43 and the top ledge 17 of front wall 14 has a corresponding pair of spaced apart openings 44. The front cover member 21 is assembled to the wrapper and rear cover member 22 by inserting the rear end of ledge 25 on each side of the front cover member 21 between the side wall top ledges 15,16 and the upwardly offset portions 47 of rear member 22 and moving front cover member 21 rearward until tabs 39 are aligned with the slots 36. The front cover member is then lowered onto the ledges 15,16 and is slid rearward until the nuts 43 align with the openings 44. Then threaded fasteners, like screws or bolts 45, are inserted through the openings 44 and received in the nuts 43. When the front cover member 21 is fully mounted on the ledges 12–14, the front portions of end caps 50,51 are juxtaposed to, and preferably abut, rear portion 26 of front cover member 21.

An L-shaped rail 60 extends across the top of rear panel 19. The vertical leg 61 of the rail 60 is attached to the upper rear portion of side panels 12,13 by screws 63 and the horizontal leg 62 of the rail projects rearward of the rear wall or panel 19. Once the rear cover member 22, with the rear wall/end cap assembly attached, is mounted on top ledges 15–17, the rear wall/end cap assembly is just above the horizontal leg 62.

The second control housing assembly includes a switch mounting plate 68 and a cover sheet 69. The elongated plate 68 is formed of relatively heavy metal, such as sheet steel, and serves as a mounting for various controls. If desired plastic caps 70 are mounted to the ends of plate 68 by suitable means such as screws 71. The plate 68 includes upper and lower ribs 72,73 which, together with the caps 70, form a rim around the periphery of the plate. A plurality of spaced apart tabs 74 project downwardly of the lower rib 73 and each tab includes a slot 75.

The cover sheet 69 conveniently may be formed of a thin sheet of decorative metal and conveniently includes graphic elements. The sheet 69 includes a generally planar front 76 surrounded by a rearwardly projecting rim or flange 77. A plurality of tabs 78 project downwardly of the lower edge of rim 77 and correspond to the slots 75 in the mounting plate 68. If desired additional tabs 79 also project downwardly of the rim 77. The plate 68 and sheet 69 are assembled by inserting the tabs 78 into the slots 75 and rotating the members 68,69 together so that the rim around the plate 68 fits within the rim or flange 77 of cover 69. Then the tabs 78, and additional tabs 79 if there are any, are bent over to secure the members 68,69 together.

The plate 68 and sheet 69 assembly is mounted on the cover 20 by inserting the tabs 74 into corresponding slots 80 formed in the upturned rear portion 26 of front cover member 21. The plate and cover sheet assembly is then rotated rearward to engage the rear wall 49 and end caps 50,51. The plate 68 and sheet 69 assembly is attached to the rear wall/end cap assembly by threaded fasteners, such as screws 81, that pass through the cover sheet 69 and plate 68 and are received in the rear wall 49 and end caps 50,51.

Any controls mounted on the plate 68 are positioned within the space defined by plate 68, rear wall 49, end caps 50,51 and rear cover member 22. It will be understood that particular control elements or devices are not part of this invention and many such controls are well known in the art. Therefore the controls have been omitted for the sake of simplicity.

While a specific embodiment of the invention has been illustrated and described herein, it is realized that modifications and changes will occur to those skilled in the art to which the invention pertains. It is therefore to be understood that the appended claims are intended to cover all such modifications and changes as fall within the true spirit and scope of the invention.

What is claimed is:

1. An appliance housing assembly including:

spaced apart side panels joined by a front panel, each of said side and front panels having a top ledge;

a cover including a front cover member having a rear portion and a rear cover member having a front portion;

said front and rear cover members being mounted on said top ledges of said side and front panels with said rear portion of said front cover member and said front portion of said rear cover member overlapping;

a control housing including an assembly of an elongated rear wall with lateral ends joined to a pair of spaced apart end caps; each of said end caps being mounted on said rear cover member and extending rearward from said rear portion of said front cover member and said rear wall extending across the rear portion of said rear cover member; and said control housing also including a control panel assembly mounted on said rear portion of said front cover member and attached to said rear wall and end cap assembly.

2. A housing assembly as set forth in claim 1, further including:

a rear panel joining the rear of said panels, said rear panel having a top ledge;

said rear cover member including at least one downwardly offset tab received under said rear panel top ledge.

3. A housing assembly as set forth in claim 1, wherein:

said front cover member includes a lower ledge;

a cooperating tab and slot arrangement positions said front cover member lower ledge in register with said top ledges of said front and side panels; and at least one fastener joins said front cover member lower ledge to said front panel top ledge.

4. A housing as set forth in claim 1, wherein:

said front portion of said rear cover member is offset upward adjacent each of said top ledges of said side panels;

said front cover member includes lower ledge portions received between each of said top ledges of said side panels and the corresponding offset portions of said rear cover member.

5. A housing assembly as set forth in claim 1, wherein:

said rear portion of said front cover member is upturned and includes a series of spaced apart slots; and said control panel assembly includes a plurality of spaced apart depending tabs with said tabs received in corresponding ones of said slots to mount said control panel assembly on said front cover member.

6. A housing assembly as set forth in claim 5, further including: fasteners releasably attaching said control panel assembly to said end cap and rear wall assembly, whereby said control panel assembly is selectively rotatable about the connection of its tabs in said corresponding slots in said rear portion of said front cover member.

7. A housing assembly as set forth in claim 1, wherein:

each of said end caps and said rear cover member include cooperating slots and hooks positioning that end cap on said rear cover member juxtaposed to said rear portion of said front cover member and at least one threaded fastener connects each of said end caps to said rear cover member.

8. A housing as set forth in claim 1, wherein: said at least one threaded fastener also connects each of said end caps and said rear cover member to the corresponding one of said side panel top ledges.

* * * * *